US011007631B2

(12) United States Patent
Didier et al.

(10) Patent No.: US 11,007,631 B2
(45) Date of Patent: May 18, 2021

(54) BIT RETENTION ASSEMBLY FOR ROTARY HAMMER

(71) Applicant: Milwaukee Electric Tool Corporation, Brookfield, WI (US)

(72) Inventors: Will Didier, Cedarburg, WI (US); Benjamin J. Ludy, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 715 days.

(21) Appl. No.: 14/155,767

(22) Filed: Jan. 15, 2014

(65) Prior Publication Data

US 2015/0197002 A1 Jul. 16, 2015

(51) Int. Cl.
*B25D 17/08* (2006.01)
*B25D 16/00* (2006.01)

(52) U.S. Cl.
CPC ..... *B25D 17/088* (2013.01); *B25D 16/00* (2013.01); *B25D 2217/003* (2013.01); *B25D 2217/0042* (2013.01); *Y10T 279/17521* (2015.01)

(58) Field of Classification Search
CPC ..... B25D 17/088; B25D 2250/321; B25D 2217/003; B25D 2217/0042; B25D 16/00; Y10T 279/17615; Y10T 279/17701; Y10T 279/17752; Y10T 279/17521; B23B 31/107; B23B 31/1071
USPC ..... 279/19, 19.6, 30, 19.4
See application file for complete search history.

(56) References Cited

U.S. PATENT DOCUMENTS 1,056,076 A * 3/1913 Wiard ..... B23B 31/1071 279/75
1,124,981 A * 1/1915 Weaver ..... B23B 31/1071 279/75
1,209,572 A * 12/1916 Fegley ..... B23B 31/1071 279/82
1,341,934 A * 6/1920 Schoenborn ..... B23B 31/1071 279/81
1,457,511 A * 6/1923 Evans ..... B23B 31/1071 279/75
2,608,413 A * 8/1952 Peck ..... B21J 15/18 279/19

(Continued)

FOREIGN PATENT DOCUMENTS

CN 201525006 7/2010
EP 0668127 2/1995

(Continued)

*Primary Examiner* — Robert F Long
*Assistant Examiner* — Eduardo R Ferrero
(74) *Attorney, Agent, or Firm* — Michael Best & Friedrich LLP

(57) ABSTRACT

A bit retention assembly, for securing a tool bit to a spindle of a rotary hammer, includes a plurality of detent members movable in unison from a locking position to an insertion position in response to insertion of the tool bit within the spindle, a biasing member configured to bias the detent members toward the locking position, and a collar movable along the spindle between a first axial position and a second axial position. The collar has an annular wall at least partially defining a pocket. A first end of the biasing member is received within the pocket when the detent members are in the locking position such that the first end of the biasing member is radially constrained by the annular wall.

18 Claims, 7 Drawing Sheets

(56) References Cited

U.S. PATENT DOCUMENTS 3,171,501 A * 3/1965 Lear ..... B25D 17/088 173/96
4,107,949 A * 8/1978 Wanner ..... B25D 17/088 279/75
4,131,165 A * 12/1978 Wanner ..... B23Q 3/12 173/133
4,202,557 A * 5/1980 Haussmann ..... B25D 17/088 279/19.5
4,284,148 A * 8/1981 Wanner ..... B25D 16/00 173/109
4,502,824 A * 3/1985 Dohse ..... B23Q 3/12 173/13
4,621,818 A * 11/1986 Rohm ..... B23B 31/123 279/158
4,692,073 A * 9/1987 Martindell ..... B23B 31/1071 279/75
4,710,079 A * 12/1987 Smith ..... B23B 31/1071 279/133
4,878,679 A * 11/1989 Plank ..... B25D 17/088 279/126
4,900,202 A * 2/1990 Wienhold ..... B23B 31/1071 279/22
5,016,892 A * 5/1991 Lafforgue ..... B25D 17/088 173/48
5,199,833 A * 4/1993 Fehrle ..... B23Q 3/12 279/19.3
5,398,946 A * 3/1995 Quiring ..... B23B 31/1071 279/145
5,437,465 A * 8/1995 Vogele ..... B23Q 3/12 279/22
5,474,139 A * 12/1995 Odendahl ..... B25D 17/088 173/104
5,603,516 A * 2/1997 Neumaier ..... B23Q 3/12 279/19.5
5,954,347 A * 9/1999 Buck ..... B23B 31/107 279/20
5,984,596 A * 11/1999 Fehrle ..... B25D 17/088 175/395
6,089,798 A * 7/2000 Wierspecker ..... B25D 17/088 279/19.4
6,092,814 A * 7/2000 Kageler ..... B25D 17/088 279/19.4
6,126,370 A * 10/2000 Wheeler ..... B23B 31/1207 279/30
6,179,300 B1 * 1/2001 Baumann ..... B23Q 3/12 279/19.4
6,241,026 B1 * 6/2001 Wache ..... B23Q 3/12 173/132
6,497,418 B2 * 12/2002 Yahagi ..... B25D 17/088 279/19.4
6,536,780 B2 * 3/2003 Baumann ..... B23Q 3/12 279/19.4
6,659,473 B2 * 12/2003 Below ..... B25D 17/088 279/19.4
6,695,321 B2 * 2/2004 Bedi ..... B25B 15/001 279/22
6,820,700 B2 * 11/2004 Funfer ..... B25D 11/005 173/132
6,854,740 B2 * 2/2005 Baumann ..... B25D 17/088 279/19.6
6,929,266 B2 * 8/2005 Peters ..... B25B 15/001 279/155
6,988,734 B2 * 1/2006 Zierpka ..... B25B 23/0035 279/125
7,258,349 B2 * 8/2007 Frauhammer ..... B23Q 3/12 279/19
7,284,622 B2 * 10/2007 Hahn ..... B25D 17/088 173/130
7,360,606 B2 * 4/2008 Saur ..... B23Q 3/12 173/132
7,533,889 B2 * 5/2009 Baumann ..... B23Q 3/12 173/93.6
7,987,930 B2 8/2011 Purcell
7,997,837 B2 * 8/2011 Furusawa ..... B23Q 3/12 279/144
8,016,523 B2 9/2011 Vasudeva et al.
8,024,995 B2 9/2011 Dayton et al.
8,061,000 B2 11/2011 Santamarina et al.
8,061,718 B2 11/2011 Krondorfer
8,061,784 B2 11/2011 Hall et al.
8,066,456 B2 11/2011 Mohr et al.
8,132,990 B2 3/2012 Bauman
8,157,021 B2 4/2012 Chen
8,162,581 B2 4/2012 Soltis et al.
8,172,236 B2 5/2012 Shibata
8,176,817 B2 5/2012 Liu
8,210,545 B2 * 7/2012 Hild ..... B23B 31/008 279/19.6
8,220,135 B2 7/2012 Vogel et al.
8,220,804 B2 7/2012 Erickson
8,286,972 B2 10/2012 Haimer
8,292,304 B2 10/2012 Wienhold
8,297,893 B2 10/2012 Hangleiter
8,308,168 B2 11/2012 Nash
8,312,944 B2 11/2012 Marshall et al.
8,366,120 B2 2/2013 Hu
8,366,121 B2 2/2013 Hu
8,366,592 B2 2/2013 Hathaway et al.
8,371,779 B2 2/2013 Steadings et al.
8,381,830 B2 2/2013 Puzio et al.
8,424,879 B2 4/2013 Reinauer
8,622,401 B2 * 1/2014 Puzio ..... B23B 31/1071 279/30
8,672,331 B2 3/2014 Braun et al.
8,800,999 B2 * 8/2014 Puzio ..... B23B 31/1071 279/30
8,844,942 B1 * 9/2014 Landowski ..... B25G 3/12 279/22
9,676,038 B2 * 6/2017 Hauptmann ..... B25D 17/088
2001/0008186 A1 * 7/2001 Frauhammer ..... B25D 17/088 173/90
2001/0017447 A1 * 8/2001 Baumann ..... B23Q 3/12 279/19.4
2001/0042964 A1 * 11/2001 Bedi ..... B25B 15/001 279/30
2002/0066502 A1 * 6/2002 Tako ..... C22C 38/40 148/318
2002/0125652 A1 * 9/2002 Hanke ..... B25D 17/06 279/19.4
2002/0172441 A1 * 11/2002 Aoki ..... F16C 33/30 384/492
2003/0025281 A1 * 2/2003 Higasi ..... B25B 23/0035 279/19.4
2003/0047887 A1 * 3/2003 Hahn ..... B25D 17/088 279/19.1
2003/0047888 A1 * 3/2003 Hahn ..... B25D 17/088 279/19.1
2003/0089509 A1 * 5/2003 Wanek ..... B25D 17/088 173/48
2004/0081523 A1 * 4/2004 Vasudeva ..... B23B 31/005 408/240
2004/0245731 A1 * 12/2004 Frauhammer ..... B23Q 3/12 279/19
2005/0161242 A1 * 7/2005 Frauhammer ..... B23Q 3/12 173/29
2006/0006614 A1 * 1/2006 Buchholz ..... B25D 17/08 279/19
2006/0163824 A1 * 7/2006 Sasaki ..... B23B 31/1071 279/75
2006/0192350 A1 8/2006 Kleine et al.
2007/0024013 A1 2/2007 Hauptmann et al.
2007/0110530 A1 * 5/2007 Baumann ..... B23Q 3/12 408/239 A
2007/0120331 A1 5/2007 Manschitz et al.
2008/0190251 A1 * 8/2008 Huang ..... B25B 23/0035 81/438
2008/0246233 A1 * 10/2008 Wienhold ..... B23B 31/1071 279/82

(56) References Cited

U.S. PATENT DOCUMENTS

2009/0044960 A1* 2/2009 Baumann ..... B23Q 3/12 173/1
2009/0277659 A1 11/2009 Roelfs et al.
2010/0176561 A1 7/2010 Braun et al.
2011/0101629 A1* 5/2011 Wienhold ..... B25B 23/0035 279/79
2011/0167969 A1 7/2011 Erickson
2011/0174121 A1 7/2011 Erickson
2011/0179915 A1 7/2011 Peng
2011/0197719 A1 8/2011 Neitzell et al.
2011/0209888 A1 9/2011 Elsworthy
2011/0215538 A1 9/2011 Cornwell et al.
2011/0227299 A1 9/2011 Yu
2011/0233878 A1 9/2011 Wan et al.
2011/0253458 A1 10/2011 Robey et al.
2011/0260415 A1 10/2011 Lin
2011/0290517 A1* 12/2011 Takeuchi ..... B25D 17/088 173/90
2012/0000684 A1 1/2012 Sugimoto
2012/0051832 A1 3/2012 Krause et al.
2012/0074657 A1 3/2012 Zhou
2012/0074658 A1 3/2012 Puzio et al.
2012/0086177 A1 4/2012 Zhou et al.
2012/0087756 A1 4/2012 Kanematsu
2012/0098214 A1 4/2012 Ronald et al.
2012/0139196 A1 6/2012 Zhou
2012/0186883 A1 7/2012 Purcell
2012/0193879 A1 8/2012 Furusawa et al.
2012/0326399 A1* 12/2012 Lin ..... B23B 31/1071 279/75
2012/0326400 A1* 12/2012 Lin ..... B23B 31/1071 279/75
2012/0326401 A1 12/2012 Puzio et al.
2013/0001897 A1 1/2013 Chen
2013/0026719 A1 1/2013 Johnsen
2013/0056940 A1 3/2013 Doberenz et al.
2013/0093142 A1 4/2013 Saur et al.
2013/0134684 A1* 5/2013 Funk ..... B25B 23/0035 279/9.1
2013/0153253 A1* 6/2013 Ludy ..... B25D 11/04 173/104
2013/0154202 A1 6/2013 Low et al.
2013/0206436 A1* 8/2013 Thorson ..... B25D 17/084 173/20

FOREIGN PATENT DOCUMENTS

EP 1157788 11/2001
EP 1238760 9/2002
EP 1958734 8/2008
FR 2981290 4/2013
GB 2114496 8/1983
GB 2416318 1/2006

* cited by examiner

BIT RETENTION ASSEMBLY FOR ROTARY HAMMER

FIELD OF THE INVENTION

The present invention relates to rotary power tools, and more particularly to bit retention assemblies for rotary power tools.

BACKGROUND OF THE INVENTION

Rotary hammers typically include a rotatable spindle, a reciprocating piston within the spindle, and a striker that is selectively reciprocable within the piston in response to an air pocket developed between the piston and the striker. Rotary hammers also typically include an anvil that is impacted by the striker when the striker reciprocates within the piston. The impact between the striker and the anvil is transferred to a tool bit, causing it to reciprocate for performing work on a work piece. Rotary hammers further include bit retention assemblies for securing a tool bit within the spindle.

SUMMARY OF THE INVENTION

The invention provides, in one aspect, a rotary hammer adapted to impart axial impacts to a tool bit. The rotary hammer includes a motor, a spindle coupled to the motor for receiving torque from the motor, a piston at least partially received within the spindle for reciprocation therein, and an anvil received within the spindle for reciprocation in response to reciprocation of the piston. The anvil imparts axial impacts to the tool bit in response to reciprocation of the piston. The rotary hammer also includes a bit retention assembly for securing the tool bit to the spindle. The bit retention assembly includes a plurality of detent members movable in unison from a locking position to an insertion position in response to insertion of the tool bit within the spindle, a biasing member configured to bias the detent members toward the locking position, and a collar movable along the spindle between a first axial position and a second axial position. The collar has an annular wall at least partially defining a pocket. A first end of the biasing member is received within the pocket when the detent members are in the locking position such that the first end of the biasing member is radially constrained by the annular wall.

The invention provides, in another aspect, a bit retention assembly for securing a tool bit to a spindle of a rotary hammer. The bit retention assembly includes a plurality of detent members movable in unison from a locking position to an insertion position in response to insertion of the tool bit within the spindle, a biasing member configured to bias the detent members toward the locking position, and a collar movable along the spindle between a first axial position and a second axial position. The collar has an annular wall at least partially defining a pocket. A first end of the biasing member is received within the pocket when the detent members are in the locking position such that the first end of the biasing member is radially constrained by the annular wall.

Other features and aspects of the invention will become apparent by consideration of the following detailed description and accompanying drawings.

DETAILED DESCRIPTION

Figure 1:
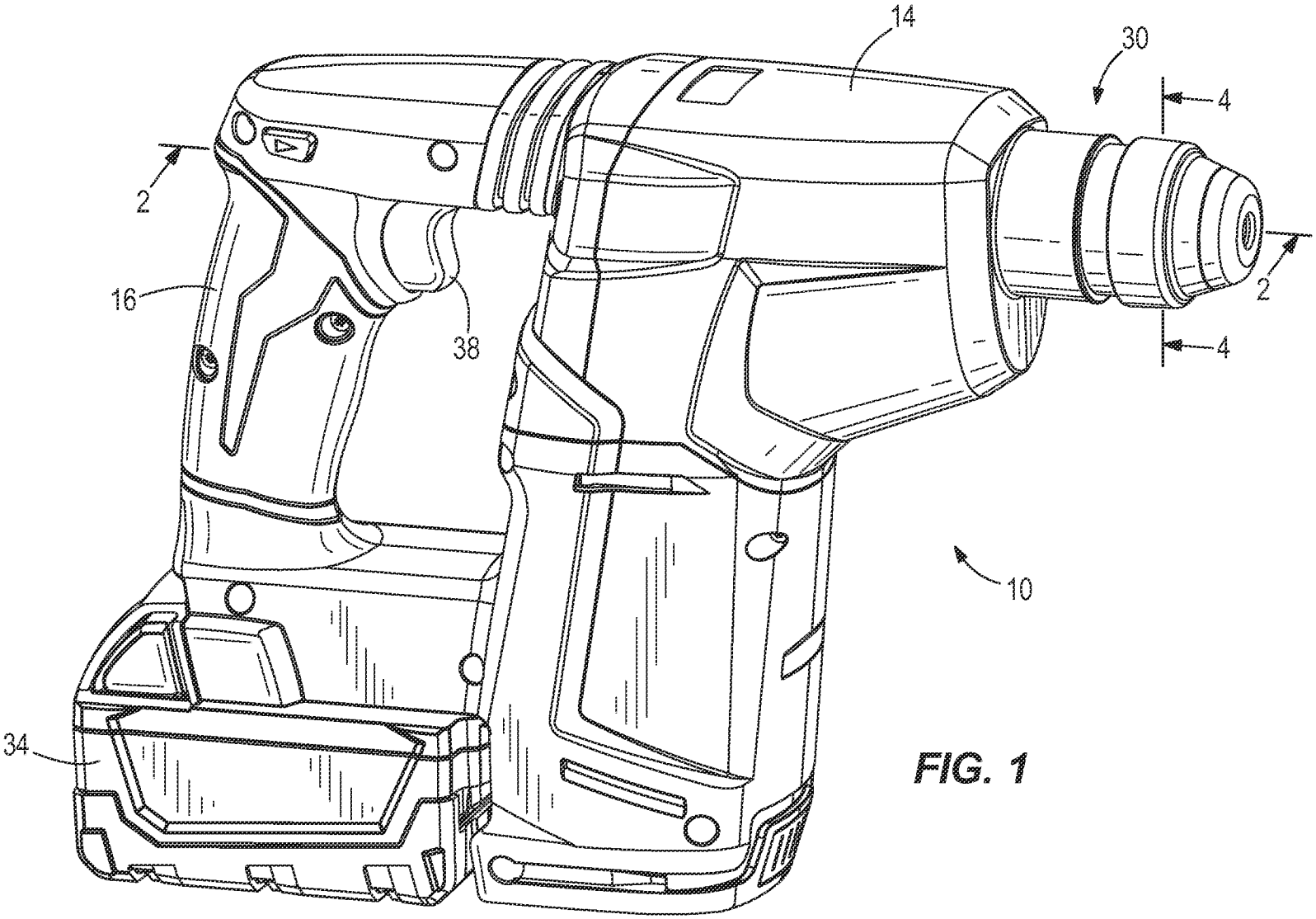
FIG. 1 is a perspective view of a rotary hammer embodying aspects of the invention.
Figure 2:
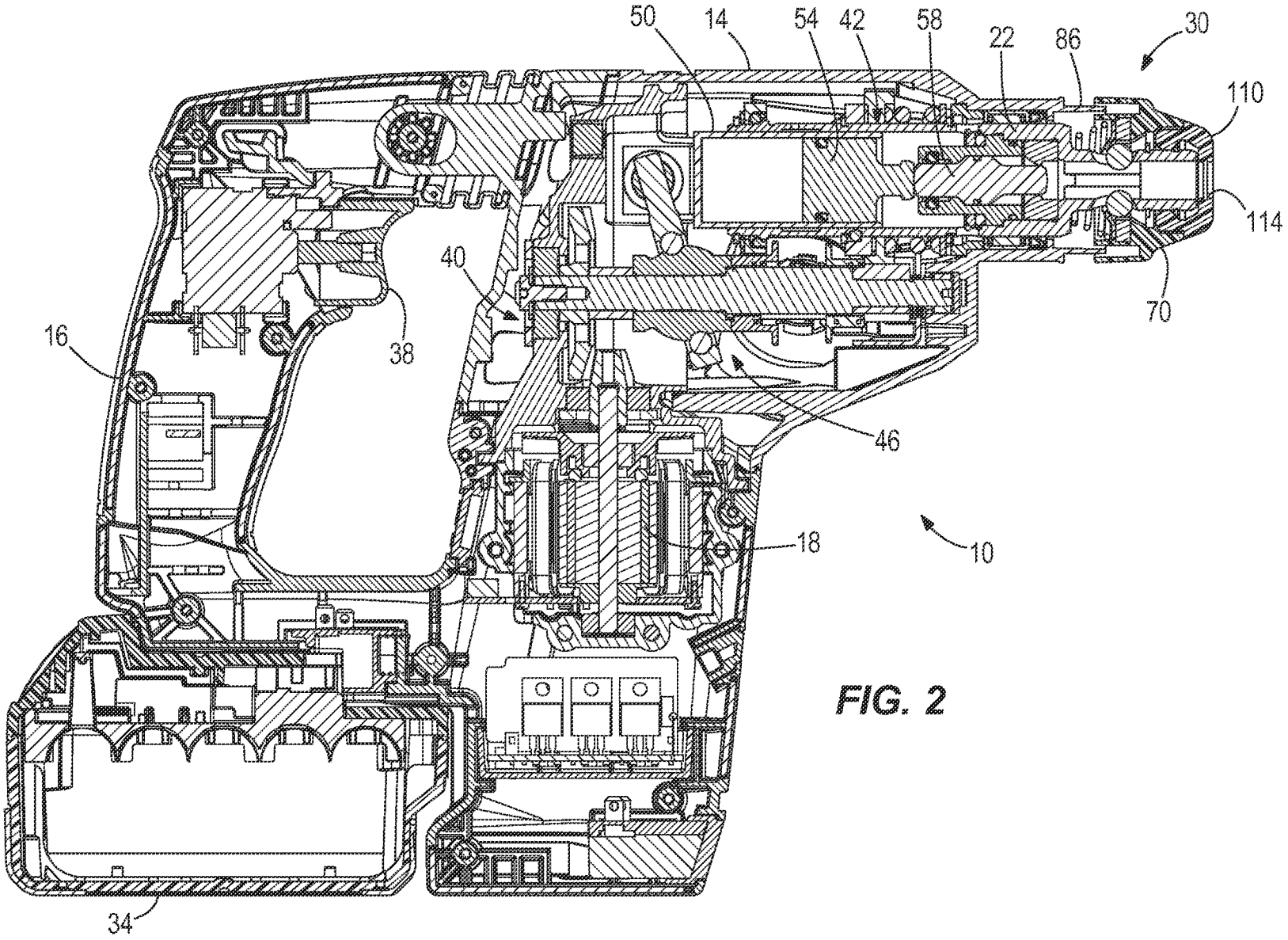
FIG. 2 is a cross-sectional view of the rotary hammer along line 2-2 in FIG. 1.

FIG. 1 illustrates a rotary hammer 10 including a housing 14 and a handle 16 coupled to the housing 14. With reference to FIG. 2, the rotary hammer 10 further includes a motor 18 disposed within the housing 14 and a rotatable spindle 22 coupled to the motor 18 for receiving torque from the motor 18. A tool bit 26 (FIGS. 5-7) may be secured to the spindle 22 for co-rotation with the spindle 22 (e.g., using a spline-fit). As described in more detail below, the rotary hammer 10 also includes a bit retention assembly 30 coupled for co-rotation with the spindle 22 to facilitate quick removal and replacement of different tool bits 26.

In the illustrated construction of the rotary hammer 10, the motor 18 is configured as a DC motor 18 that receives power from an on-board power source 34 (e.g., a battery, FIG. 1). The battery 34 may include any of a number of different nominal voltages (e.g., 12V, 18V, etc.), and may be configured having any of a number of different chemistries (e.g., lithium-ion, nickel-cadmium, etc.). Alternatively, the motor 18 may be powered by a remote power source (e.g., a household electrical outlet) through a power cord. The motor 18 is selectively activated by depressing a trigger 38 which, in turn, actuates a switch. The switch may be electrically connected to the motor 18 via a top-level or master controller, or one or more circuits, for controlling operation of the motor 18.

With reference to FIG. 2, the rotary hammer 10 also includes a transmission 40 for transferring torque from the motor 18 to the spindle 22, an impact mechanism 42 driven by the transmission 40 for delivering repeated impacts to the tool bit 26, and a reciprocation mechanism 46 for converting torque received from the motor 18 to a reciprocating force acting on the impact mechanism 42. In the illustrated embodiment, the impact mechanism 42 includes a reciprocating piston 50 disposed within the spindle 22 movable between a forward-most position within the spindle 22 and a rearward-most position within the spindle 22. The impact mechanism 42 also includes a striker 54 that is selectively reciprocable within the spindle 22 in response to reciprocation of the piston 50, and an anvil 58 that is impacted by the striker 54 when the striker 54 reciprocates toward the tool bit 26. The impact between the striker 54 and the anvil 58 is transferred to the tool bit 26, causing it to reciprocate for performing work on a work piece. In the illustrated construction of the rotary hammer 10, an air pocket is developed between the piston 50 and the striker 54 when the piston 50 reciprocates within the spindle 22, whereby expansion and contraction of the air pocket induces reciprocation of the striker 54.

Figure 3:
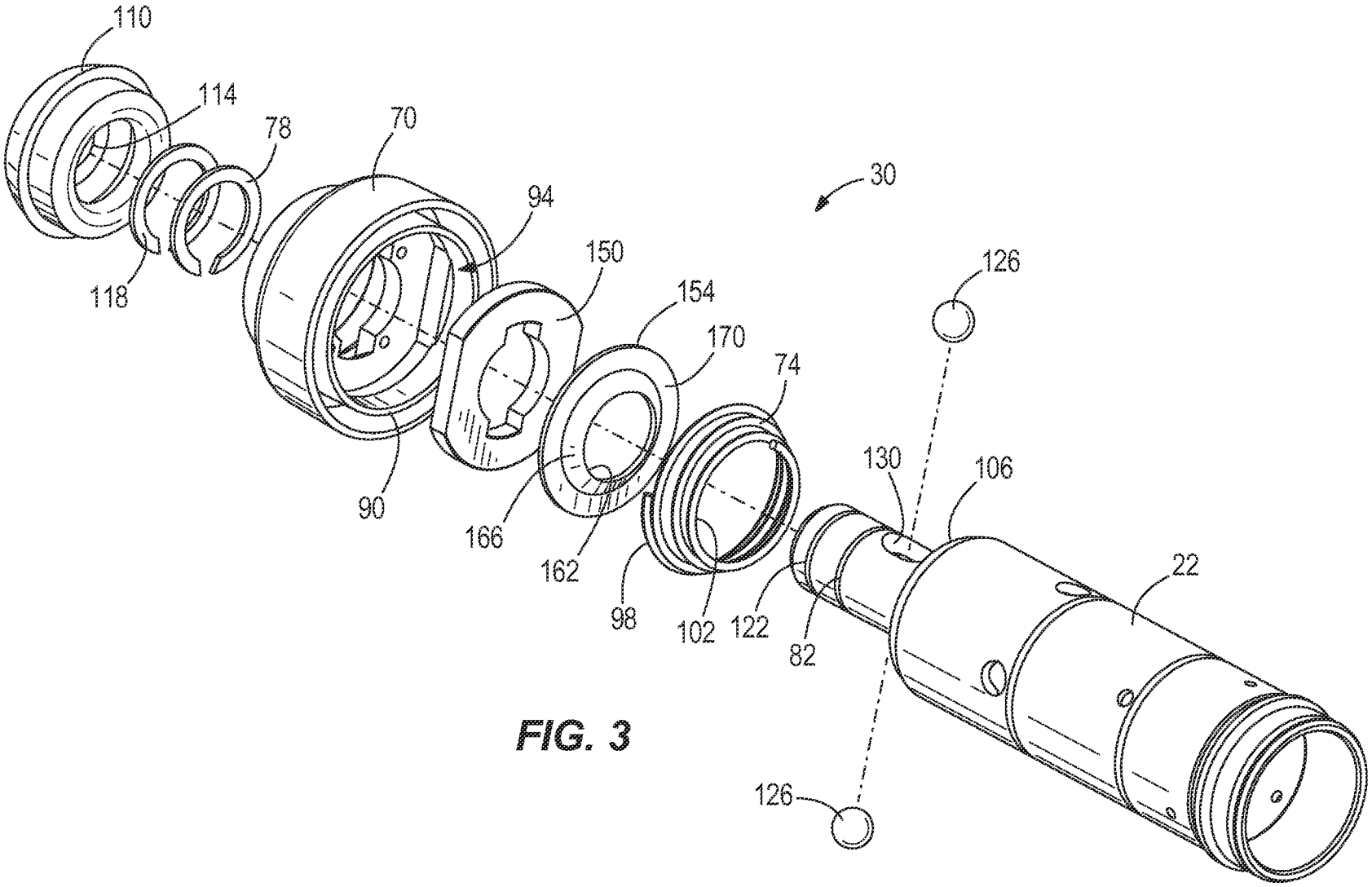
FIG. 3 is an exploded view of a bit retention assembly for use with the rotary hammer of FIG. 1.

With reference to FIGS. 2, 3, and 5-7, the bit retention assembly 30 includes a collar 70 that is axially displaceable along the spindle 22 of the rotary hammer 10 between a first or forward position (FIGS. 5 and 6) and a second or rearward position (FIG. 7), against the bias a coil spring 74. The collar 70 is prevented from moving beyond the forward position by a first retaining ring 78, such as a split ring or C-ring, received within a first retaining groove 82 of the spindle 22 (FIG. 3). The collar 70 is prevented from moving beyond the rearward position by an annular projection 86 (FIG. 2) extending from the housing 14 of the rotary hammer 10.

Best illustrated in FIG. 3, the collar 70 includes an annular wall 90 at least partially defining a pocket 94 for receiving a first end 98 of the spring 74. The pocket 94 and spring 74 are sized such that the first end 98 of the spring 74 is radially constrained by the annular wall 90, thus stabilizing the first end 98 of the spring 74. A second or opposite end 102 of the spring 74 is engaged with a shoulder 106 on the spindle 22.

The rotary hammer 10 further includes a cap 110 located at a front end of the spindle 22. The cap 110 has a hole 114 through which the tool bit 26 extends when the tool bit 26 is fully inserted within the spindle 22. In the illustrated embodiment, the cap 110 is made of rubber. Alternatively, the cap 110 may be made of any other suitable material. The cap 110 is secured to the spindle 22 by a second retaining ring 118, such as a split ring or C-ring, received within a second retaining groove 122 of the spindle 22. Because the collar 70 is retained on the spindle by the first retaining ring 78, the bit retention assembly 30 is still functional if the cap 110 is removed.

Figure 4:
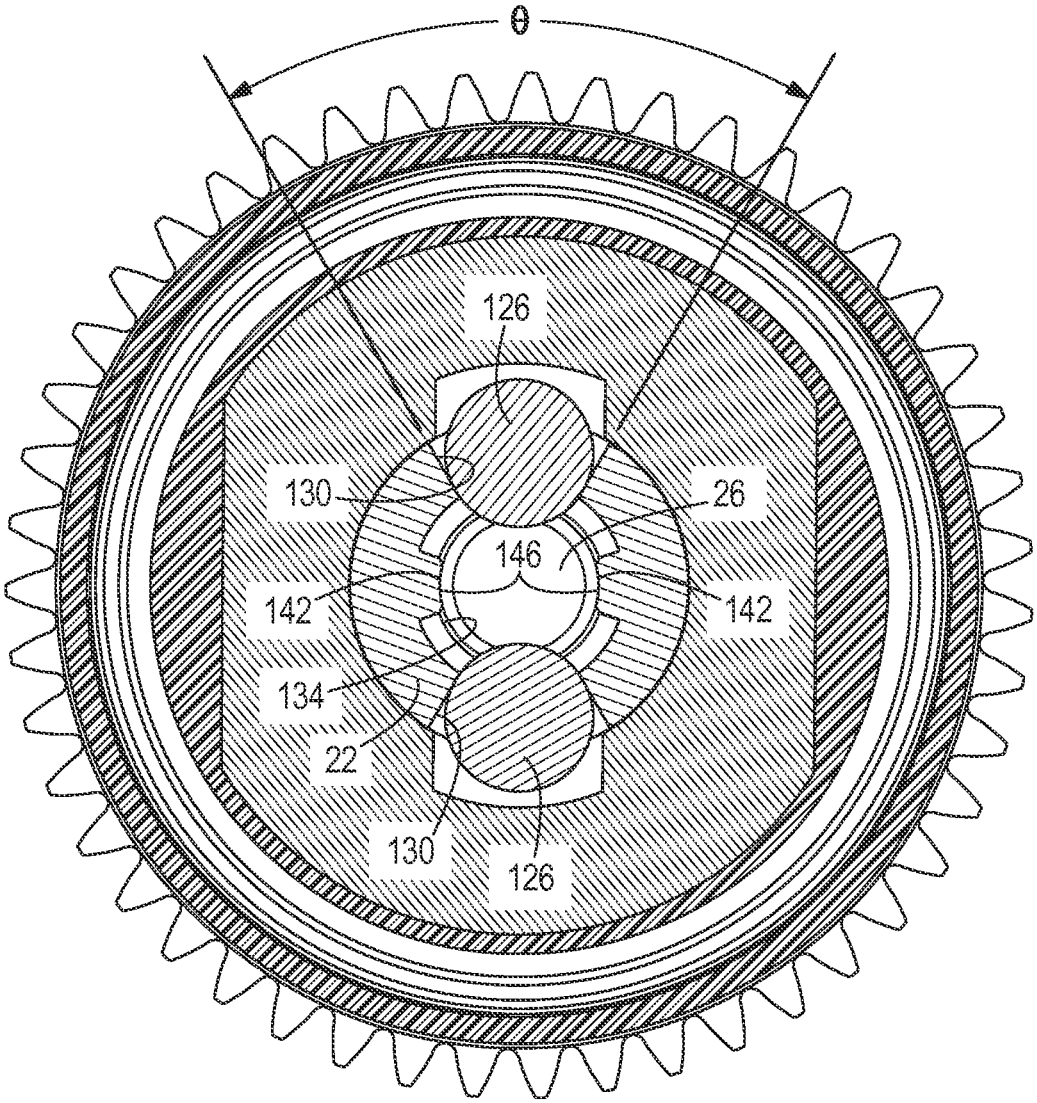
FIG. 4 is a cross-sectional view of the rotary hammer along line 4-4 in FIG. 1.
Figure 6:
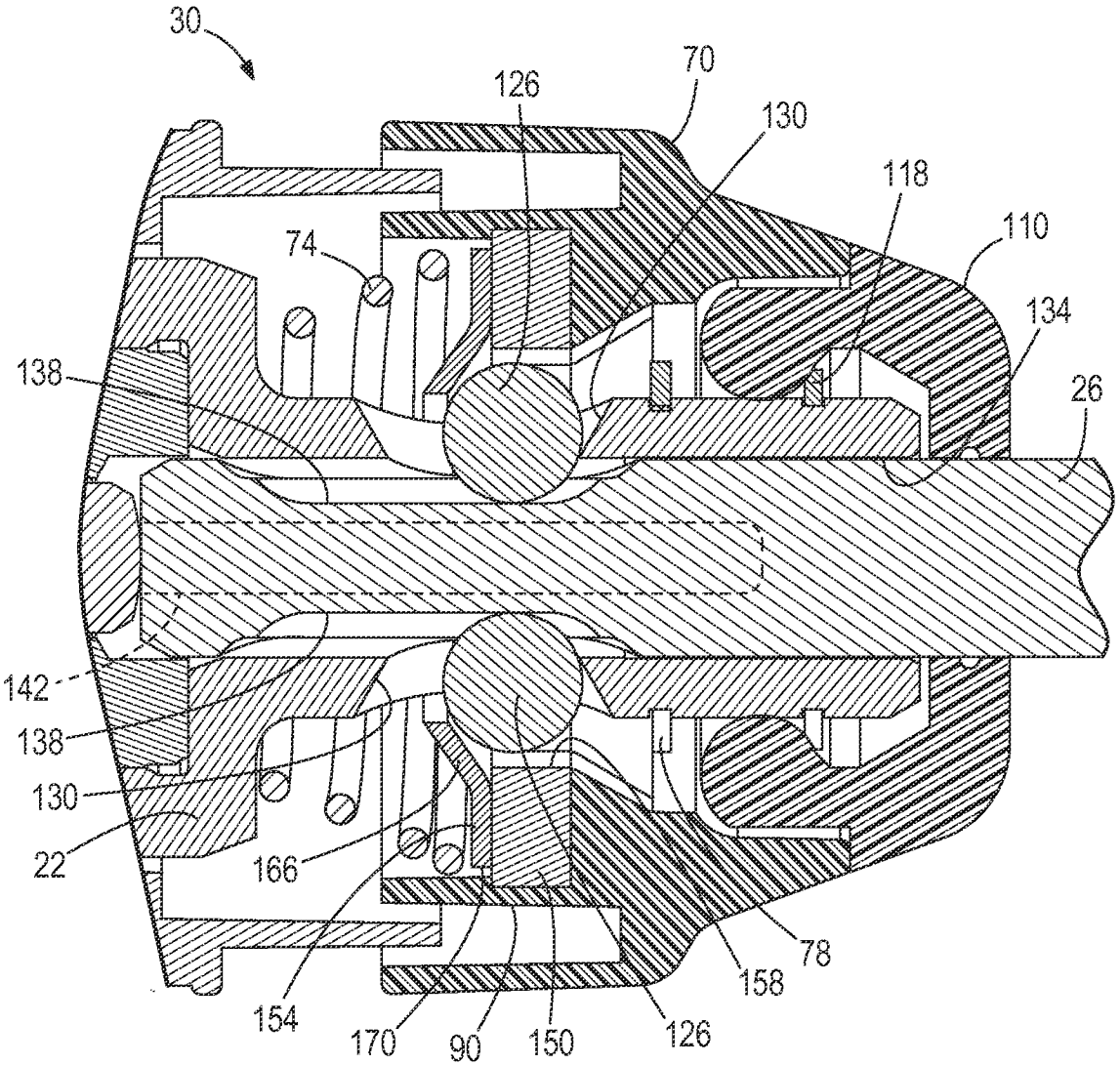
FIG. 6 is a cross-sectional view of the bit retention assembly of FIG. 2, illustrating the tool bit fully inserted within the spindle.

With reference to FIGS. 4 and 6, the bit retention assembly 30 further includes a pair of opposed detent members or balls 126 that are maintained within respective slots 130 formed in the spindle 22. The slots 130 extend between an exterior of the spindle 22 and a receptacle 134 in which the tool bit 26 is inserted. When the tool bit 26 is properly or fully inserted into the receptacle 134, the balls 126 are at least partially received in corresponding indentations 138 formed in a rear portion of the tool bit 26 (i.e., a locking position; FIG. 6) to define the extent to which the tool bit 26 may reciprocate within the spindle 22. The tool bit 26 also includes a pair of opposed, axially-extending keyways 142 that slidably receive corresponding keys 146 located in the receptacle 134 of the spindle (FIG. 4). The engagement between the keys 146 and the keyways 142 provides the primary torque transfer means between the tool bit 26 and the spindle 22. In the illustrated embodiment, the keys 146 and keyways 142 are offset from the balls 126, slots 130, and indentations 138 by an angle of about 90 degrees. The spindle 22 is made of a case-hardened steel to increase the durability of the spindle 22 and particularly of the keys 146. In some embodiments, the steel may be hardened using a carbonitriding heat treatment process, in which atoms of carbon and nitrogen are diffused into the steel. In other embodiments, the steel may be hardened using any other suitable process, such as a boronizing process. Alternatively, the spindle 22 may be made of any other suitably hard and durable material.

With continued reference to FIG. 4, the slots 130 in the spindle 22 define an included slot angle θ between about 30 degrees and about 90 degrees. In the illustrated embodiment, the slot angle θ is about 60 degrees. This relatively steep angle θ allows the engagement between the balls 126 and the indentations 138 in the tool bit 26 to provide a secondary torque transfer means between the tool bit 26 and the spindle 22. As such, if the keys 146 and/or keyways 142 begin to wear, torque may still be reliably transmitted to the tool bit 26.

Figure 5:
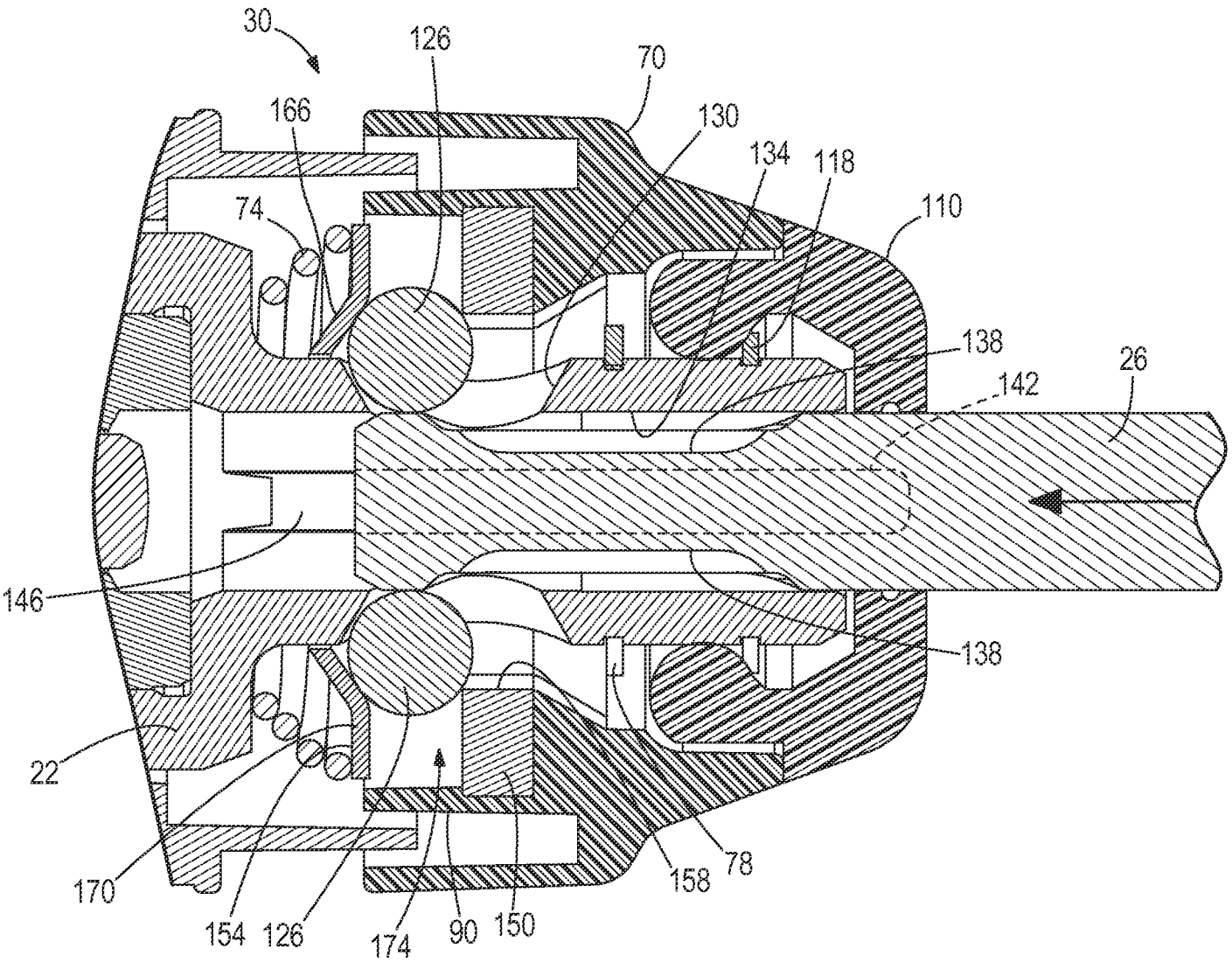
FIG. 5 is a cross-sectional view of the bit retention assembly of FIG. 2, illustrating a tool bit being inserted within a spindle of the rotary hammer.
Figure 7:
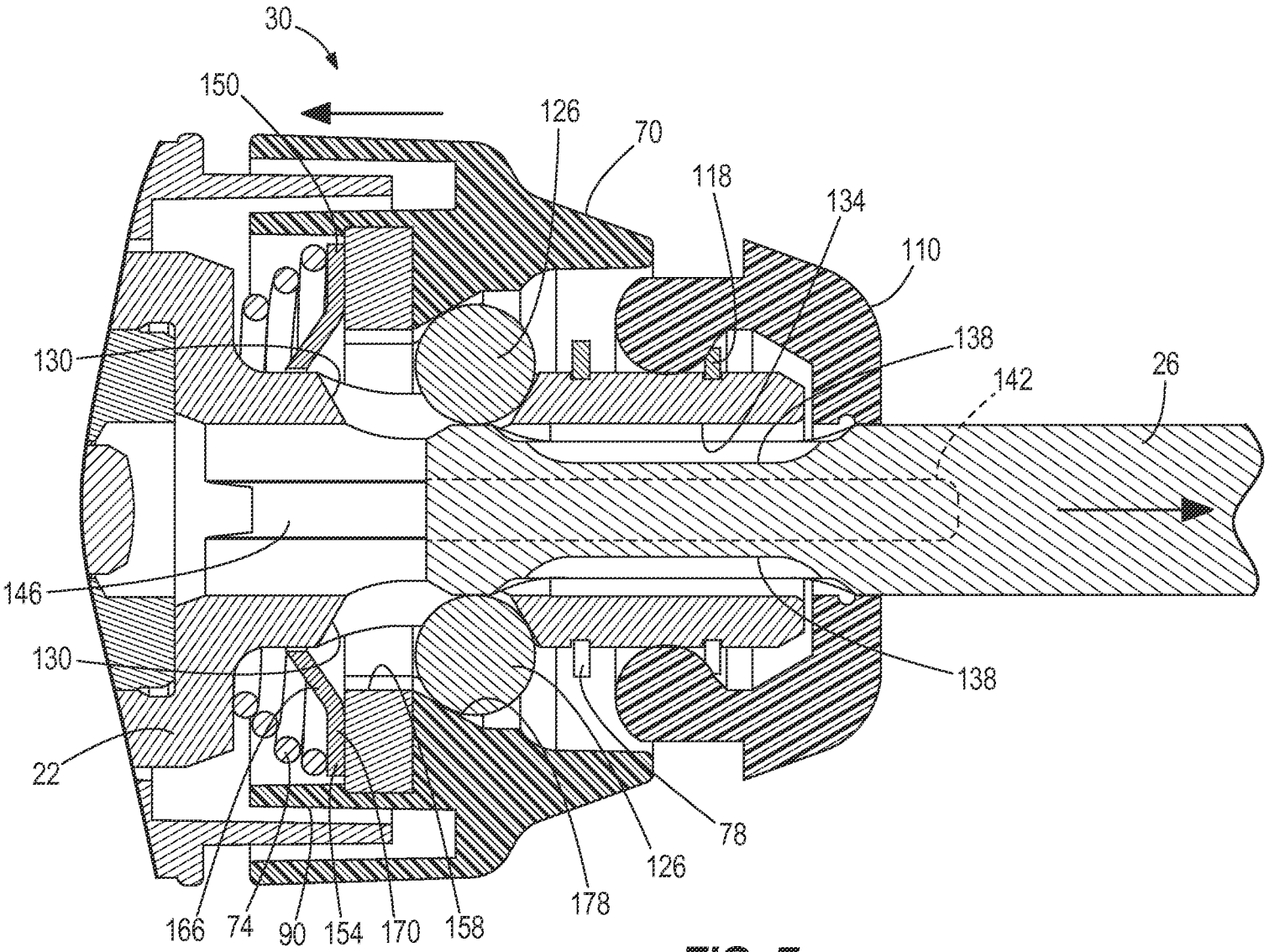
FIG. 7 is a cross-sectional view of the bit retention assembly of FIG. 2, illustrating a collar of the bit retention assembly being moved to a rearward position to permit removal of the tool bit from the spindle Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Referring to FIGS. 5-7, the bit retention assembly 30 further includes a ring 150 fixed within the pocket 94 of the collar 70 and a washer 154 positioned between the spring 74 and the collar 70. In the illustrated embodiment, the ring 150 is insert molded with the collar 70; however, the ring 150 may be fixed to the collar 70 by any other suitable method. The ring 150 is positioned radially outward of the balls 126 when in the position of FIG. 6, such that an inner surface 158 of the ring 150 prevents the balls 126 from being displaced out of the indentations 138 when the tool bit 26 is fully inserted within the spindle 22.

Best illustrated in FIG. 3, the washer 154 includes a circular aperture 162 through which the spindle 22 extends, a tapered inner portion 166 adjacent the aperture 162, and a substantially flat outer periphery 170. In the illustrated embodiment, the inner portion 166 has a frustoconical shape that is substantially uniform in a circumferential direction. The spring 74 bears against the outer periphery 170 of the washer 154, and the inner portion 166 of the washer engages the balls 126 to bias the balls 126 forward in the slots 130.

To secure the tool bit 26 within the bit retention assembly 30, the tool bit 26 is inserted within the spindle 22, causing the rear portion of the tool bit 26 to engage the balls 126 to push them rearward against the washer 154 and the bias of the spring 74. Because the inner portion 166 of the washer 154 is substantially uniform in the circumferential direction, the balls 126 move rearward in unison. When the balls 126 clear the ring 150, the balls 126 are also displaced radially outward toward a gap 174 created between the washer 154 and the ring 150 (i.e., in an insertion position), until the balls 126 clear the end of the tool bit 26. The balls 126 and washer 154 are returned to the position shown in FIG. 6 by the spring 74 in response to the balls 126 clearing the end of the tool bit 26, at which time the balls 126 are at least partially received in the indentations 138 of the tool bit 26 (i.e., the locking position) to define the extent to which the tool bit 26 may reciprocate within the spindle 22.

To release the tool bit 26 from the bit retention assembly 30, the collar 70 is pushed to the rearward position against the bias of the spring 74, thereby moving with it the washer 154 and the ring 150 (FIG. 7). The balls 126 become aligned with an annular recess 178 in the collar 70 adjacent the ring 150, allowing the balls 126 to be displaced radially outward and into the annular recess 178 (i.e., in a release position) in response to a removal force applied to the tool bit 26.

Various features of the invention are set forth in the following claims.

What is claimed is:

1. A rotary hammer adapted to impart axial impacts to a tool bit, the rotary hammer comprising:

a motor;

a spindle coupled to the motor for receiving torque from the motor, the spindle including a first retaining groove and a second retaining groove spaced from the first retaining groove;

a piston at least partially received within the spindle for reciprocation therein;

an anvil received within the spindle for reciprocation in response to reciprocation of the piston, the anvil imparting axial impacts to the tool bit in response to reciprocation of the piston;

a bit retention assembly for securing the tool bit to the spindle, the bit retention assembly including a plurality of detent members movable rearward in unison from a forwardmost locking position to a rearmost insertion position in response to insertion of the tool bit within the spindle, a biasing member configured to bias the detent members toward the locking position, a collar movable along the spindle in an axial direction between a first axial position and a second axial position, the collar having an annular wall at least partially defining a pocket, and a ring insert molded with the collar such that the ring is fixed within the pocket;

wherein an inner surface of the ring radially constrains the detent members when the detent members are in the locking position and the collar is in the first axial position;

wherein a first end of the biasing member is received within the pocket when the detent members are in the locking position such that the first end of the biasing member is radially constrained by the annular wall;

a first retaining ring received within the first retaining groove of the spindle and engageable with the collar to prevent axial movement of the collar past the first axial position;

a cap located at a front end of the spindle, the cap including a front portion defining a hole through which the tool bit extends when the tool bit is inserted within the spindle and a rear portion with a projection having a substantially rounded profile in the axial direction; and a second retaining ring received within the second retaining groove of the spindle, the second retaining ring configured to engage the projection to retain the cap on the spindle, wherein the cap is removable from the spindle, wherein the first retaining ring is configured to prevent axial movement of the collar past the first axial position when the cap is removed from the spindle, and wherein the projection of the cap is positioned between the first retaining ring and the second retaining ring when the cap is retained on the spindle.

2. The rotary hammer of claim 1, wherein the spindle includes a receptacle in which the tool bit is received, and a plurality of slots extending between an exterior of the spindle and the receptacle, each of the slots receiving a corresponding one of the plurality of detent members therein.

3. The rotary hammer of claim 2, wherein each of the slots has an included slot angle between about 30 degrees and about 90 degrees.

4. The rotary hammer of claim 3, wherein each of the slots has an included slot angle of about 60 degrees.

5. The rotary hammer of claim 2, wherein the spindle further includes a pair of keys projecting inwardly into the receptacle, and wherein the tool bit includes a pair of axially-extending keyways that slidably receive the keys when the tool bit is inserted within the spindle.

6. The rotary hammer of claim 5, wherein the tool bit further includes a plurality of indentations, each of the indentations receiving a corresponding one of the plurality of detent members therein when the tool bit is inserted within the spindle and when the detent members are in the locking position.

7. The rotary hammer of claim 6, wherein torque is transferred from the spindle to the tool bit through the keys and through the detent members.

8. The rotary hammer of claim 1, wherein the plurality of detent members comprises two opposed balls.

9. The rotary hammer of claim 1, wherein the bit retention assembly further includes a washer disposed between the first end of the biasing member and the plurality of detent members, wherein the washer includes a tapered inner portion that engages the detent members to bias the detent members toward the locking position.

10. The rotary hammer of claim 9, wherein the washer includes a generally flat outer periphery, wherein the outer periphery of the washer contacts the ring when the detent members are in the locking position, and wherein the outer periphery of the washer is spaced from the ring to form a gap in which at least a portion of the detent members are received when the detent members are in the insertion position.

11. The rotary hammer of claim 9, wherein the washer further includes a circular aperture through which the spindle extends.

12. The rotary hammer of claim 11, wherein the tapered inner portion has a frustoconical shape that is substantially uniform in a circumferential direction.

13. The rotary hammer of claim 1, wherein the detent members are movable from the locking position to a release position in response to a removal force being applied to the tool bit when the collar is in the second axial position.

14. The rotary hammer of claim 1, wherein the spindle is made of material hardened by a carbonitriding process.

15. The rotary hammer of claim 1, further comprising a striker received within the spindle for reciprocation in response to reciprocation of the piston, wherein the anvil is positioned between the striker and the tool bit.

16. The rotary hammer of claim 1, wherein the biasing member is a coil spring.

17. The rotary hammer of claim 1, wherein the spindle includes a shoulder, and wherein a second end of the biasing member bears against the shoulder.

18. A rotary hammer adapted to impart axial impacts to a tool bit, the rotary hammer comprising:

a motor;

a spindle coupled to the motor for receiving torque from the motor, the spindle including a first retaining groove and a second retaining groove spaced from the first retaining groove;

a bit retention assembly for securing the tool bit to the spindle, the bit retention assembly including a plurality of detent members movable rearward from a locking position to an insertion position in response to insertion of the tool bit within the spindle, a biasing member configured to bias the detent members toward the locking position, a collar movable along the spindle in an axial direction between a first axial position and a second axial position, and a ring fixed to the collar, wherein an inner surface of the ring radially constrains the detent members when the detent members are in the locking position and the collar is in the first axial position;

a first retaining ring received within the first retaining groove of the spindle and engageable with the collar to prevent axial movement of the collar past the first axial position;

a cap located at a front end of the spindle, the cap including a front portion defining a hole through which the tool bit extends when the tool bit is inserted within the spindle and a rear portion with a projection having a substantially rounded profile in the axial direction; and a second retaining ring received within the second retaining groove of the spindle, the second retaining ring configured to engage the projection to retain the cap on the spindle, wherein the cap is removable from the spindle, wherein the first retaining ring is configured to prevent axial movement of the collar past the first axial position when the cap is removed from the spindle, and wherein the projection of the cap is positioned between the first retaining ring and the second retaining ring when the cap is retained on the spindle.

* * * * *